United States Patent [19]

Ikeda et al.

Best Available Copy

[11] 4,289,937

[45] Sep. 15, 1981

[54] SPEAKER WITH FINE GRAIN FERROMAGNETIC MATERIAL ON CENTER POLE OR RING

[75] Inventors: Hideo Ikeda; Hideshi Tsuchiya; Masaru Okada, all of Amagasaki, Japan

[73] Assignee: Mitsubishi Denki Kabushiki Kaisha, Tokyo, Japan

[21] Appl. No.: 37,893

[22] Filed: May 10, 1979

[30] Foreign Application Priority Data

May 30, 1978 [JP] Japan ..... 53-64727
Jun. 7, 1978 [JP] Japan ..... 53-68684

[51] Int. Cl.[3] ..... H01F 1/00; H04R 9/06

[52] U.S. Cl. ..... 179/119 R; 29/607; 335/231

[58] Field of Search ..... 179/119 R, 120, 117, 179/114 R, 115.5 R; 335/231; 29/607; 75/123 M; 148/12 EA, 121

[56] References Cited

U.S. PATENT DOCUMENTS

| | | | |
|---|---|---|---|
| 2,027,994 | 1/1936 | Mishima | 179/117 X |
| 3,573,897 | 4/1971 | Wache | 75/123 M |
| 3,665,352 | 5/1972 | Dietrich et al. | 335/231 |
| 3,922,501 | 11/1975 | Yamamuro | 179/115.5 R |
| 3,936,323 | 2/1976 | Kazeva | 148/12 EA |
| 3,971,676 | 7/1976 | Detert et al. | 148/121 |
| 4,075,437 | 2/1978 | Chin et al. | 179/114 R |
| 4,119,445 | 10/1978 | Bosch et al. | 75/123 M X |

*Primary Examiner*—Thomas W. Brown
*Attorney, Agent, or Firm*—Oblon, Fisher, Spivak, McClelland & Maier

[57] ABSTRACT

A speaker comprises a voice coil placed in an air gap between a center pole and a plate wherein a specific ferromagnetic material obtained by forming fine crystalline grains is used on at least one of the surfaces of the center pole and the plate which respectively face the voice coil, thereby providing a speaker having low distortion.

6 Claims, 3 Drawing Figures

SPEAKER WITH FINE GRAIN FERROMAGNETIC MATERIAL ON CENTER POLE OR RING

BACKGROUND OF THE INVENTION

1. Field of the Invention

As the conventional magnetic circuit, a column center pole and a ring permanent magnet are placed on a disc yoke and a ring plate is placed on the permanent magnet so as to form a magnetic gap between the plate and the center pole. The voice coil is placed in the magnetic gap. In usual, the center pole and the plate are made of soft iron and are magnetized by the magnetic field of the permanent magnet.

When AC signal current is passed through the voice coil, the AC magnetic field is produced and the magnetic materials are magnetized by both the AC magnetic field and the DC magnetic field. This state of magnetization forms a minor hysteresis loop. The minor hysteresis loop is non-linear because of the non-linearity of the permeability, $\mu$ of the soft iron as the magnetic material. Accordingly, even though sinusoidal AC voltage is applied to the voice coil, harmonic components are formed in the current whereby harmonic distortion is caused in the reproduced sound in the speaker drive system.

In order to overcome these disadvantages, various improvements have been proposed. For examples, (1) a thin plate made of magnetic material is laminated on at least one facing part of the yoke (plate) and the center pole, parallel to the direction of the DC magnetic flux for excitation (Japanese Unexamined Patent Publication No. 22117/1974) and (2) a magnetic material (ferronickel alloy) having the rectangular hysteresis magnetic property which is not saturated by magnetic flux density in the gap is used (Japanese Unexamined Patent Publication No. 17011/1977).

There has been some success in reducing distortion by these improvements, however it has not been entirely satisfactory. The result of the various studies on the reduction of harmonic distortion has been published in Mitsubishi Electric ADVANCE Vol. 51 No. 12, 1977 page 789–792, "Reducing Harmonic Distortion in Speaker Drive Systems."

SUMMARY OF THE INVENTION

The present invention is to provide a speaker comprising a voice coil placed in a gap between a center pole and a plate wherein a ferromagnetic material obtained by forming fine ferrite crystalline grains having ASTM number of more than 5, preferably 7 to 10, and especially 8 to 10 is used on the surfaces of the center pole and the plate which respectively face the voice coil, whereby the minor hysteresis loop is linearized and sound distortion in the speaker drive system is reduced.

DETAILED DESCRIPTION OF THE PREFERRED EMBODIMENTS

Figure 1:
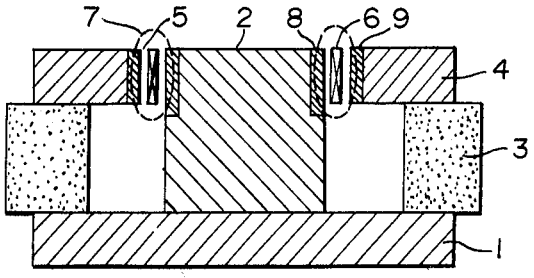
FIG. 1 shows a magnetic circuit of a speaker of the present invention.

In FIG. 1, the reference numeral (1) designates a disc yoke; (2) designates a column center pole mounted at the center of the yoke (1); (3) designates a ring permanent magnet mounted on the yoke (1) so as to surround the center pole (2); (4) designates a ring plate which is mounted on the permanent magnet (3) and is placed so as to form a gap (5) between the ring plate and the center pole (2); (6) designates a voice coil placed in the gap (5) so as to pass AC signal current through the voice coil; (7) designates an AC magnetic field formed by the voice coil (6); (8) designates a ferromagnetic ring placed to face the voice coil (6) of the center pole (2); (9) designates a ferromagnetic ring placed in the side of the plate (4). The ferromagnetic rings (8), (9) are prepared by rolling 50% Ni-Fe alloy plate by a hot-rolling technique to give a thickness of 3.5 mm, bending and drawing it to form a cylindrical shape, cutting it to a desired size and annealing it to remove stress. The size of the ferrite crystalline grains of the 50% Ni-Fe alloy is remarkably reduced by the bending or drawing process in comparison with the ferrite crystalline grains just after the hot-rolling.

In one example, ferrite crystalline grain having grain size number of ASTM No. 1–2 (average numbers of crystalline grains of 1–2 per 25 $mm^2$ of field of view of a microscope at 100 times magnification) after the hot-rolling step is converted to that of grain size number of ASTM No. 8 (average numbers of crystalline grains of 128). When the size of the ferrite crystalline grains is reduced, the size of the magnetic domain is reduced and the unbalance of magnostatic energy is compensated in these small magnetic domains to prevent the coherent-reversal of magnetization. The reversal of magnetization in these magnetic domains is dependant upon the intensity of magnetic field, and the minor hysteresis loop of the 50% Ni-Fe alloy is linearized.

Figure 2:
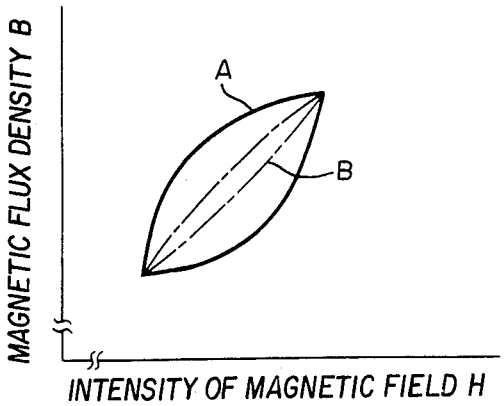
FIG. 2 shows minor hysteresis loops of soft iron used for the magnetic circuit of the conventional speaker and a ferromagnetic material obtained by forming fine ferrite crystalline grains used for the magnetic circuit of the speaker of the present invention.

FIG. 2 shows the minor hysteresis loop (A) of the conventional soft iron and the minor hysteresis loop (B) of the 50% Ni-Fe alloy. As it is shown in FIG. 2, the minor hysteresis loop (A) of the soft iron is largely non-linear whereas the minor hysteresis loop (B) of the 50% Ni-Fe alloy is substantially linear.

Figure 3:
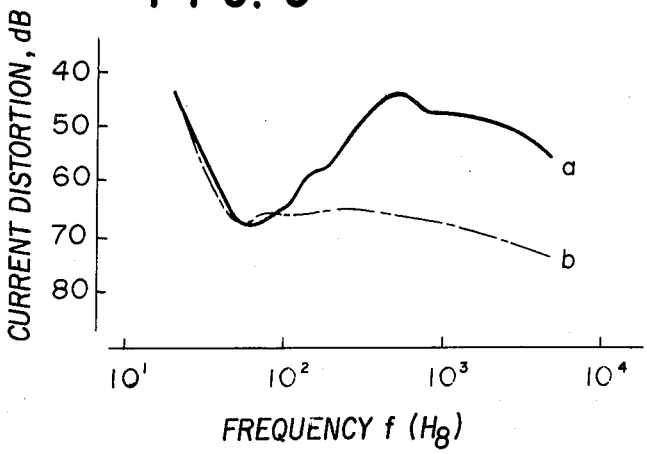
FIG. 3 shows frequency response of current distortion of the speaker wherein a mild steel and a ferromagnetic material are used in the magnetic circuit.

FIG. 3 shows the frequency response (a) of current distortion of the conventional speaker wherein the magnetic circuit is formed by the soft iron and the frequency response (b) of current distortion of the speaker of the present invention wherein the magnetic circuit is formed in accordance with the present invention.

As it is shown in FIG. 3, the sound distortion is about 1/10 (−20 dB) of that of the conventional speaker. That is, reproduced sound having less distortion can be obtained.

A typical example of heat treatment after the bending step will be illustrated.

The 50% Ni-Fe alloy is rolled by a hot-rolling technique to a thickness of 3.5 mm. The plate is bent to form a cylindrical shape having an outer diameter of 60 mm. It is then processed to produce the desired sizes and heat-treated at 750° C. for 2 hours in a nitrogen atmosphere.

The magnetic characteristic is improved by the heat treatment compared to the magnetic characteristic just after the bending step.

The above-mentioned condition is only one example and can be modified as follows.

The Ni-Fe alloy is rolled to form a plate having a thickness of 1–10 mm and the plate is bent to form a cylindrical shape having an outer diameter of 10–150 mm and heat-treated at a furnace temperature of 650° C.–850° C. for ¼–3 hours in nitrogen, air or hydrogen atmosphere. When this is used in the magnetic circuit, the sound distortion can be reduced.

When the thickness of the ferromagnetic material of 50% Ni-Fe alloy is less than 1 mm, the effect of reducing the distortion is not attained, whereas when it is more than 10 mm, the cost of the material is increased but the effect is not further improved. It is preferable to have a thickness of 3–5 mm.

When the outer diameter of the cylindrical shape is less than 10 mm, accuracy of the processing is not satisfactory whereas when it is more than 150 mm, any practical use can not be considered in view of the magnetic circuit of the speaker which is commercially available.

When the furnace temperature is lower than 650° C., the residual stress cannot be eliminated, whereas when it is higher than 850° C., grain growth is initiated to deteriorate the linearity of the minor hysteresis loop. The furnace temperature is preferably in the range of 700° C.–800° C. The holding time is preferably in the range of ¼–3 hours for the same reason.

In the example, the 50% Ni-Fe alloy is used. However, the ferromagnetic material can be pure iron, low carbon steel or ferrite stainless steel which have fine crystalline grains whose size is reduced.

In the example, the size of crystalline grains of ferrite is reduced by applying mechanical stress of the bending process or the drawing process. The size of crystalline grains of ferrite can be reduced by incorporating the specific element in the ferromagnetic material. The reduction of the distortion can be also accomplished by using such modified ferromagnetic material.

The modified ferromagnetic material incorporating the specific element will be illustrated.

The structure of the speaker is the same as that of FIG. 1. The ring fitted on the upper peripheral part of the center pole (2) and the ring fitted on the inner surface of the plate (4) which are faced to the voice coil (6) are made of the modified ferromagnetic material containing titanium (Ti). In the modified ferromagnetic material (8), (9) containing titanium, the size of the austenite crystalline grains is reduced during the heating for casting or annealing by the effect of titanium. Moreover, the size of the crystalline grain of ferrite is reduced since recrystallization is inhibited during the rolling step. The size of the magnetic domain is reduced depending upon the reduction of the size of the crystalline grain. As the result, the minor hysteresis loop is linearized.

When the ferromagnetic material containing titanium is placed near the voice coil, the sound distortion can be remarkably reduced.

The modified ferromagnetic material can be also obtained by incorporating niobium (Nb), vanadium (V) or aluminum (Al) instead of the titanium (Ti). It is also possible to incorporate a mixture of said components selected from Ti, Nb, V and Al.

One embodiment wherein the magnet is placed on the outer surface of the center pole is shown in the above-mentioned example. However, the present invention can be also applied to the situation where the magnet is present as the lower portion of the center pole.

In the example, the ferromagnetic rings are fitted on the center pole and on the plate. However, the effect for reducing the distortion can be attained by using the ferromagnetic ring only on one of them.

In accordance with the present invention, the magnetic circuit of the speaker is formed by using the ferromagnetic material obtained by forming fine crystalline grains, on at least one of the surfaces of the center pole and the plate which respectively face to the voice coil, thereby providing a speaker having low distortion.

What is claimed is:

1. A speaker comprising a disc yoke, a ring permanent magnet and centerpole on said yoke, a ring plate on said ring permanent magnet, said centerpole and ring plate being placed so as to create an air gap, and a voice coil placed in said air gap;

wherein said voice coil produces an AC magnetic field when AC signal current passes through the voice coil;

wherein at least one of the areas of said centerpole and said ring plate which face said voice coil is formed of different material from the remaining portions of said centerpole and said ring plate, said different material being a ferromagnetic material with fine crystalline grains having an average of sixteen (16) or more grains per twenty-five square millimeters of field of view of a microscope at magnification of 100, and having a reduced magnetic domain size;

wherein the different material produces a substantially linear magnetic minor hysteresis loop for the magnetic circuit of the speaker.

2. A speaker according to claim 1 wherein the ferromagnetic material having fine crystalline grains is obtained by drawing a ferromagnetic plate prepared by rolling.

3. A speaker according to claim 2 wherein the ferromagnetic material is Ni-Fe alloy.

4. A speaker according to claim 1 wherein the ferromagnetic material having fine crystalline grains is obtained by incorporating at least one of the metals selected from the group of Ti, Nb, V, and Al into a ferrous metal selected from the group of pure iron, low carbon steel and ferritic stainless steel.

5. A speaker according to claim 1 wherein the ferromagnetic material having fine cyrstalline grains is obtained by bending a ferromagnetic plate prepared by rolling to form a cylindrical shape.

6. A speaker according to claim 5 wherein the ferromagnetic material is Ni-Fe alloy.

* * * * *